US006339949B1

(12) United States Patent
Takamatu

(10) Patent No.: US 6,339,949 B1
(45) Date of Patent: Jan. 22, 2002

(54) DEEP DRAWING METHOD

(76) Inventor: Tutomu Takamatu, 1749-12, Yazuka-machi, Soka-shi, Saitama-ken (JP)

( * ) Notice: Subject to any disclaimer, the term of this patent is extended or adjusted under 35 U.S.C. 154(b) by 0 days.

(21) Appl. No.: 09/620,205

(22) Filed: Jul. 17, 2000

(30) Foreign Application Priority Data

Jul. 30, 1999 (JP) ..... 11-216149
Jun. 16, 2000 (JP) ..... 12-181477

(51) Int. Cl.[7] ..... B21D 22/00
(52) U.S. Cl. ..... 72/347; 72/350; 29/423
(58) Field of Search ..... 72/347, 350, 363, 72/471; 29/423

(56) References Cited

U.S. PATENT DOCUMENTS 909,342 A * 1/1909 Smith ..... 72/350
1,834,111 A * 12/1931 Rode ..... 72/350
3,070,055 A * 12/1962 Webb ..... 72/350
3,263,637 A * 8/1966 Cox ..... 72/347
3,314,275 A * 4/1967 Mullen ..... 72/350
3,670,393 A * 6/1972 Almond ..... 29/423
5,644,943 A * 7/1997 Lanz ..... 72/350

* cited by examiner

*Primary Examiner*—Lowell A. Larson
(74) *Attorney, Agent, or Firm*—Winderoth, Lind & Ponack, L.L.P.

(57) ABSTRACT

There is provided a method of deep drawing magnesium material, which material is superior in environmental compatibility and energy saving properties. The deep drawing method of the invention uses a die having a male mold 1 with a convex portion, and a female mold having a concave surface. In the method of the invention, a mounting table is placed between the male mold and the female mold for supporting a magnesium plate, and a layer of a plurality of thin resin films is placed on the magnesium plate. Further, a central portion of the magnesium plate is kept in contact with the convex portion 12 of the male mold, and the concave surface of the female mold is moved to cooperate with the convex portion of the male mold so that deep draw forming of the magnesium plate is achieved.

27 Claims, 8 Drawing Sheets

Fig. 12 (Prior Art)
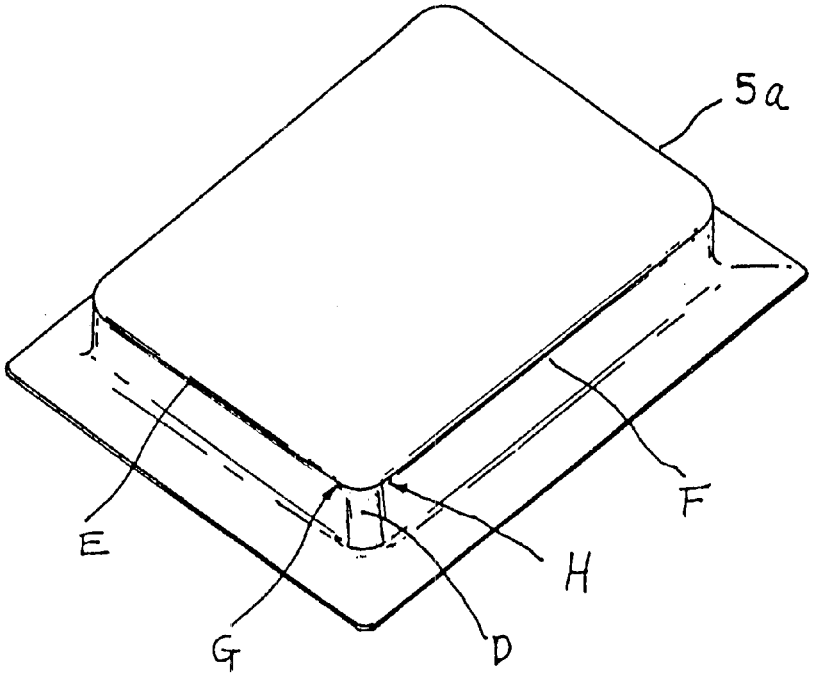
Fig. 13 (PriorArt)
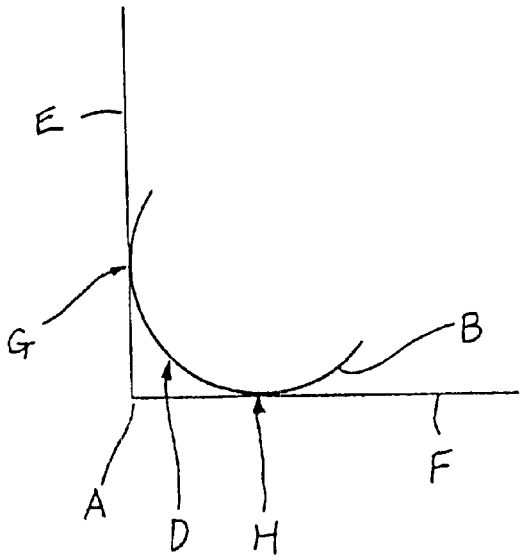

DEEP DRAWING METHOD

BACKGROUND OF THE INVENTION

This invention relates to a method of deep drawing hard metal material such as magnesium.

Heretofore, there have been distributed extensively various kinds of plastic products and, as a result, a large quantity of plastic refuse and waste have been generated or dumped. Plastic waste has been incinerated together with combustible waste, which results in a serious problem of generation of atmospheric pollution and other environmental problems. Moreover, plastic products, even if they are withdrawn for the purpose of recycling, have disadvantages in that the cost associated with their recycling is high, whereby recycling thereof into new products is not profitable. Therefore, a rate of withdrawal of plastic products has been extremely low.

There has been advocated the use of magnesium material as substitutes or alternates for the plastic material, and casting of magnesium material has been proposed. However, cast products of magnesium are limited in their shape. Further, if deep drawing is carried out by press working, it is likely that products are cracked and, therefore, it has been difficult to provide successful press working.

An attempt has been made to overcome the difficulties as described above by using a press working die which is heated by a suitable electric heater or the like to about 250° C. However, this has a disadvantage in that dies must be heated every time a press working operation is to be carried out, which results in a serious drawback with regard to working efficiency. Further, a magnesium plate is increasingly hardened as it is repeatedly subjected to press working; and thus it becomes difficult to deep draw a magnesium plate and moreover, there is a serious problem in that cracks and seams are generated on surfaces of the formed products.

SUMMARY OF THE INVENTION

An object of the present invention is to provide a new deep drawing method for magnesium plates.

Another object of the invention is to provide a new deep drawing method for magnesium plates, which are for structural purposes and have good recycling characteristics, environmental compatibility and energy saving properties.

According to an aspect of the present invention, there is provided a deep drawing method comprising using a die having a male mold with a convex forming surface and a female mold with a concave forming surface, comprising the steps of:

placing a vertically movably mounting table, which supports thereon a magnesium plate, between the male mold and the female mold, placing a plurality of thin resin films on the magnesium plate, keeping a central portion of the magnesium plate contacted with the convex forming surface of the male mold and moving the concave forming surface of the female mold relative to the convex forming surface of the male mold, thereby achieving a deep drawing of the magnesium plate.

In the deep drawing method according to the present invention, a layer of the thin resin films consists of at least two vinyl films each having a thickness of 0.02 mm. Also, it is preferred that the magnesium plate has a thickness of about 1.5 mm.

In the deep drawing method of the present invention, a pressure is applied to the magnesium plate by a base plate which is removably fitted on an upper surface of the concave forming surface of the female mold, while a vertical movement of the mounting table is adjusted by an extension device such as a hydraulic cylinder.

Further, in the deep drawing method of the present invention, the female mold has four female elements having an L-shaped cross section and fitted on a lower surface of the base plate. Each of the four female elements has a concave forming surface at its upper side of each inner corner surface for forming (i.e., for secondary molding) purposes, and an outwardly dilated guide surface, for molding purposes, continuously extending from the lower side of the concave forming surface.

Further, in the present invention, the female mold has four female elements having an L-shape cross section, and each inner corner surface has a concave forming surface. Each of the female elements is radially movably fitted to a lower surface of the base plate with a resilient element being mounted therein so that each of the female elements can be moved radially within a predetermined range. Further, supporting members each being positioned between adjacent female elements are fixed to the lower surface of the base plate to restrict a recovery position of the female elements, and the female elements are recovered to their original positions by a spring force of the resilient element that biases the female elements which have been radially pushed outwardly by the male element.

A shrinkage restriction plate can be fitted to either the male mold or female mold.

In the present invention described above, pre-pressing or molding (i.e., primary forming) is carried out by the outwardly dilated guide concave surface at the lower side of the female mold before further fabrication (i.e., secondary molding is performed) by the female mold, and then continuous finishing is performed by the concave forming surface, so that an excessive force is prevented from being applied concentrically to the curved surface of the mold. Further, two or three films of vinyl each having a thickness of 0.02 mm are disposed between the magnesium plate and the female guide surface (that is, the concave guide surface and the concave forming surface) and therefore, no shrinkage or contraction is produced between the die (or molds) and the magnesium plate and a smooth folding fabrication can be achieved without any trouble.

Further, the forming method of the present invention comprises the steps of: placing a shrinkage restriction plate, which has an opening for receiving the male mold inserted therein, between the male mold and the female mold; placing at a lower portion of the shrinkage restriction plate a cantilever plate that is vertically movable in the female mold so that an upper surface of the cantilever plate is placed on the same plane as the female mold; providing a coupling rod so that the cantilever plate is disposed on an upper end of the coupling rod; providing a supporting base for fixing a lower end of the coupling rod; providing a resilient support member for supporting the supporting base; and inserting the male mold into the female mold, with a circumferential end portion of the magnesium plate being held by the shrinkage restriction plate. The shrinkage restriction plate can be fitted to either the male mold or the female mold.

Also, in the forming method of the present invention, the shrinkage restriction plate can be vertically movably mounted on the base plate for the male mold, and a spring element can be provided to downwardly bias the shrinkage restriction plate. If necessary, the female mold can be fitted at its upper surface by a fixing member.

Further, the forming method of the present invention utilizes a male mold or die that includes a generally rectangular surface having four corner portions, and a female mold or die having a correspondingly shaped opening. Each corner portion has a first side and a second side interconnected by an obliquely extending end surface. A first arc located within an angle formed by the first side and the end surface is tangent to the first side and the end surface at first and second locations, respectively. And, a second arc located within an angle formed by the second side and the end surface is tangent to the second side and the end surface at third and fourth locations, respectively. The first second, third and fourth locations along with a portion of the end surface located between the second and fourth locations are interconnected by a continuous curve.

In the method described above, several contact portions, that is five concentrations of force are provided at the corners or the curved surface portions to diffuse or disperse the concentration of the force to five cross points, so that the concentrated force can be dispersed. Therefore, the concentration of the force by the press working is dispersed to at least five locations so that generation of shrinkage or cracks on the curved portions can be prevented effectively.

BRIEF DESCRIPTION OF THE DRAWINGS

FIG. 12 is a perspective view of a product which is produced by form working by providing three points for concentration of force on a curved surface of a magnesium plate.

FIG. 13 is an explanatory, exaggerated diagram of a corner portion shown in FIG. 12.

DETAILED DESCRIPTION OF THE EMBODIMENTS

Figure 1:
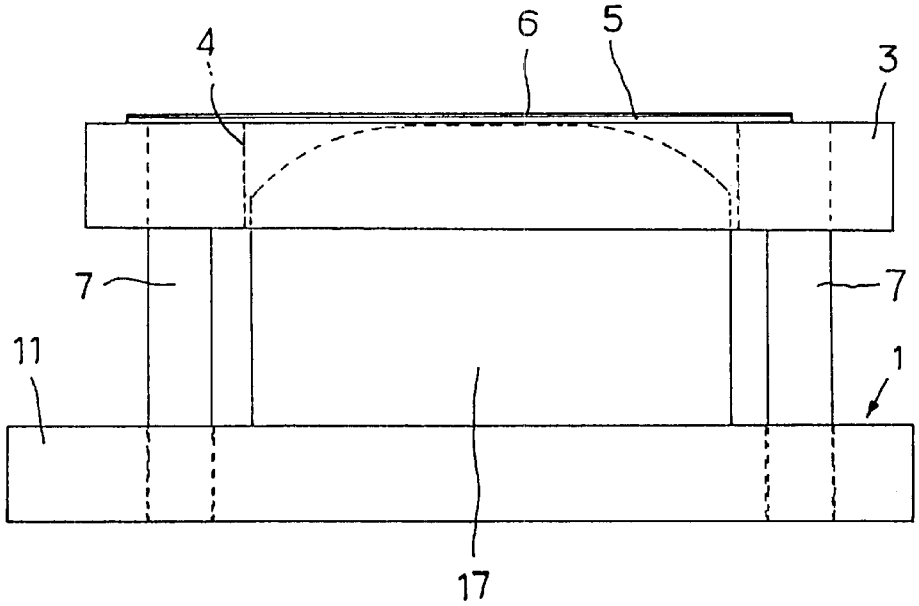
FIG. 1 is an explanatory diagram showing a male mold and a mounting table used for a deep drawing method according to a first embodiment of the present invention.

A first embodiment of the invention will be described with reference to the accompanying drawings wherein FIG. 1 shows a relationship between a male mold 1, a vertically movable magnesium plate 5 to be shaped, and a mounting table 3 which has, at its central portion, a substantially rectangular opening portion 4 for receiving therein a convex portion 12 of the male mold 1, which will be described presently.

On the mounting table 3, a magnesium plate 5 is placed so that it covers the opening portion 4 of the mounting table 3 and, on top of the magnesium plate 5, a plurality of, preferably two or three, resin thin films 6 such as styrene, vinyl or the like, each having a thickness of about 0.02 mm, are superposed or disposed in an overlapping relation. By providing the two or three thin resin films as described above, each of the resin films can be freely moved or slid relative to each other, and accordingly, generation of shrinkage or contraction of the magnesium plate 5, which is positioned between a female mold or die 2 and the convex portion 12 of the male mold or die 1, can be prevented to thereby provide a desired finished surface.

The convex portion (that is, a convex forming surface) 12 of a desired shape is provided on an upper surface of a male base 11, which is a lower portion of the male mold 1, so that the convex portion 12 is placed in a confronting relation with the female mold 2 which will be described presently. Extension devices 7, 7 which are formed of hydraulic cylinders or the like are mounted to both of each of the male base 11 and the mounting table 3 so that vertical movement of the mounting table 3 relative to the male base 11 can be realized.

Figure 2:
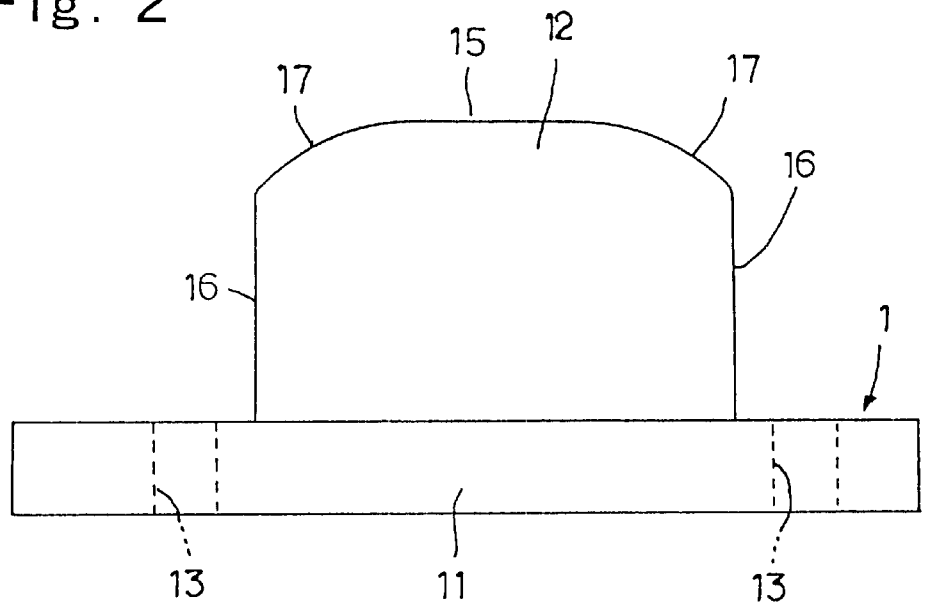
FIG. 2 is a front view of the male mold that is a first die of the first embodiment.

As illustrated in FIG. 2, the convex portion 12 of the male mold 1 has a flat top surface 15, a vertical side surface 16 and an arc surface 17 which is located between, and connects, the two surfaces 15 and 16. The arc surface 17 is defined by an incomplete arc-shaped configuration that results from cutting one end portion of an arc adjacent to the vertical side surface 16.

Figure 3:
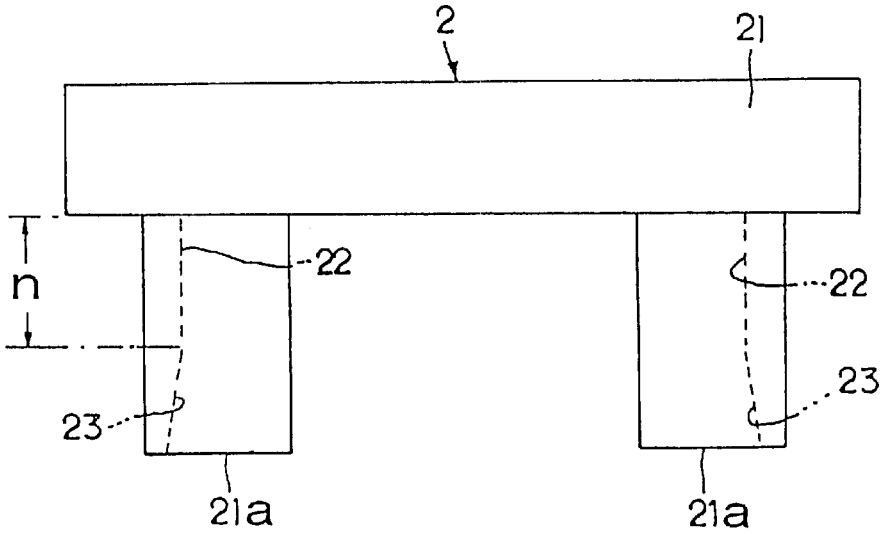
FIG. 3 is a front view of the female mold that is a second die of the first embodiment.
Figure 4:
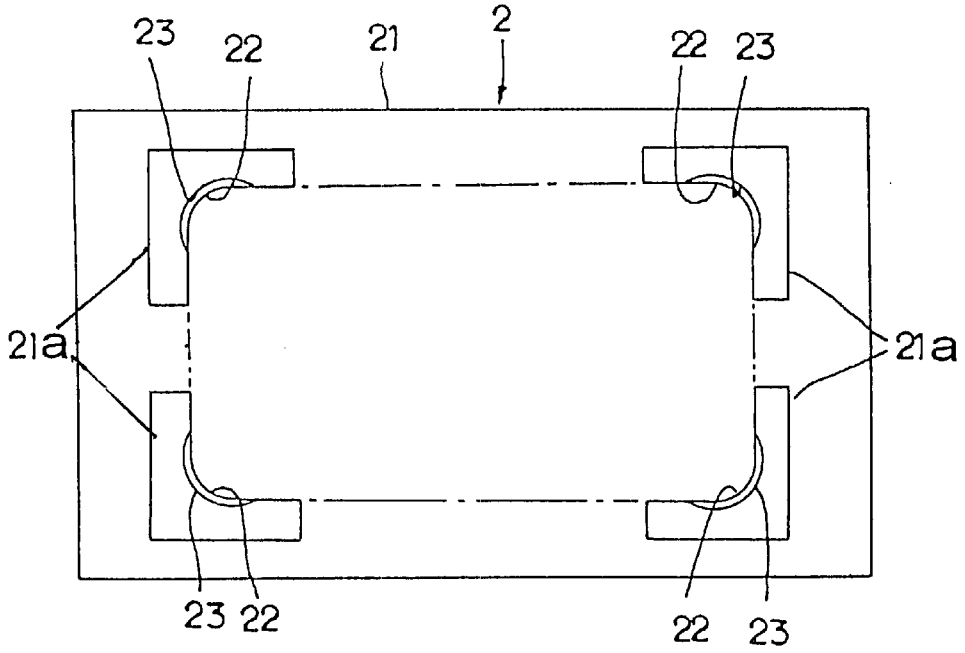
FIG. 4 is a bottom view of the female mold of the first embodiment.

With reference to FIGS. 3 and 4 showing the female mold 2, there are provided four female mold elements 21*a* at corners of a lower surface of a base plate 21 which has a substantially rectangular shape similar to the male mold 1, and the female mold elements 21*a* each have an L-shaped transversal cross section. At an upper side of an internal angle surface of the female mold element 21*a,* a concave surface portion (concave forming surface) 22 is provided for finishing purposes or secondary fabrication. The concave surface portion 22 extends vertically from the lower surface of the base plate 21 for a predetermined distance "n". Preferably, the concave surface portion 22 extends to a mid-portion of the female mold element 21*a*.

On a lower side (that is, at the lowest portion) of the internal angle surface of the female mold elements 21*a,* an arc shaped surface extending in an outwardly dilated fashion is provided. This arc shaped surface is a concave guide portion 23 that extends downwardly in a fan shape for the purpose of performing prefabrication or a primary fabrication. In other words, the female mold element 21 a has a concave surface portion 22 for the finish or secondary fabrication at an upper portion thereof and, at a lower portion thereof, a concave guide portion 23 which is outwardly dilated for primary fabrication.

Figure 5:
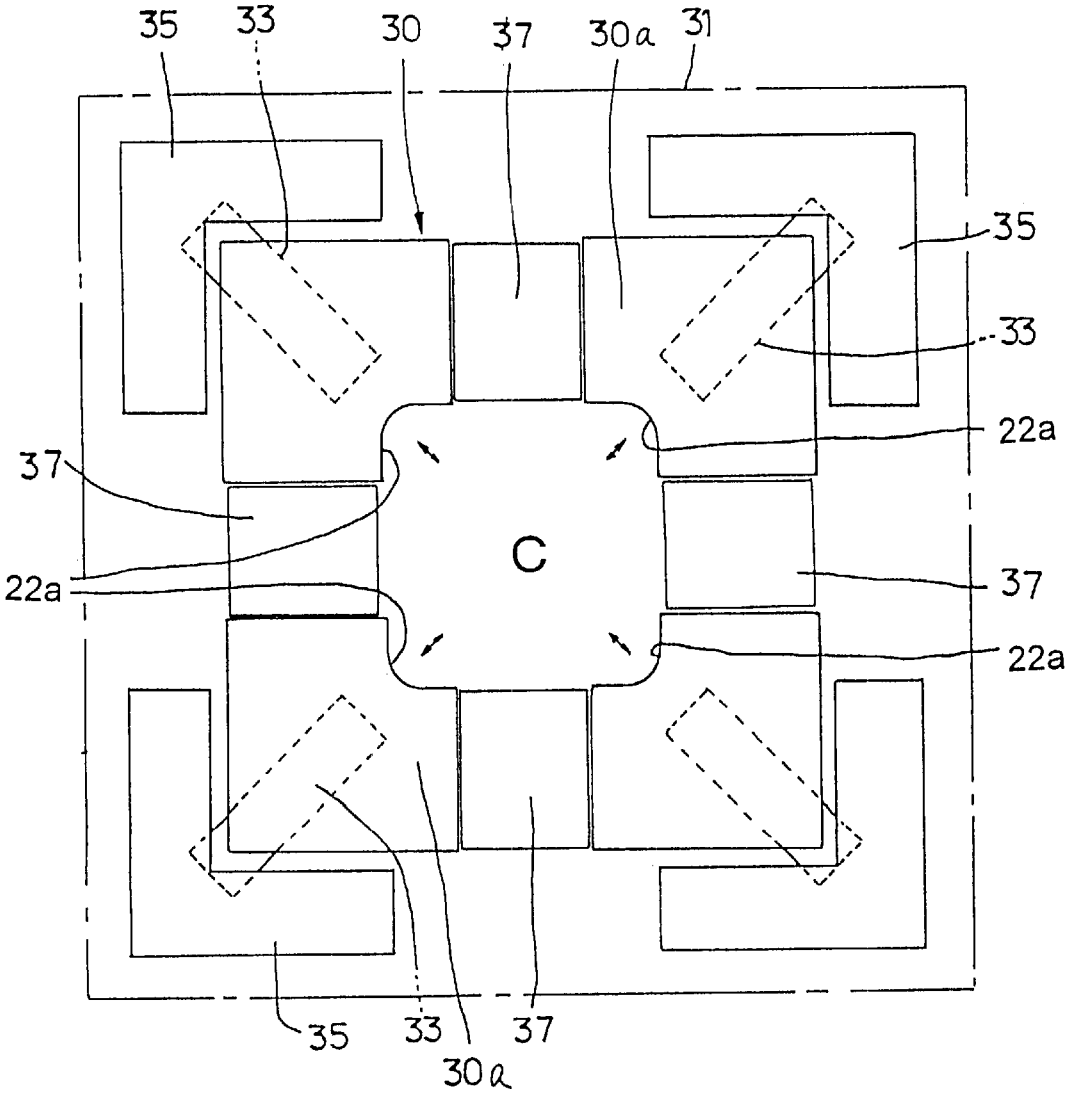
FIG. 5 is an explanatory diagram of a female mold of a second embodiment, viewed from the bottom thereof.

In FIG. 5 which shows a female mold or die 30 in a second embodiment of the invention, the female mold 30 is fitted on a lower surface of a base plate 31 and is radially movable from a center thereof In otherwords, the female mold 30 includes four female mold elements 30*a* in such a manner that each female mold element is provided on a lower surface of the base plate 31 and has, at its internal angle surface, a concave forming surface 22*a* so that each female mold element 30*a* is in a confronting relation with each other and is movable in a radial direction within a predetermined range.

In the female mold element 30*a,* a resilient element 33 such as a spring, rubber element, etc. is mounted, and supporting members 37, 37 are fixed to a lower surface of the base plate 31 and placed between the female mold elements 30*a* for limiting the position of each of the female mold elements, so that each of the female mold elements can be returned to its original position.

One end of the resilient element 33 is engaged with each of the female mold elements 30*a,* and the other end is engaged with an interior of a supporting member 35 which has an L-shape and is positioned outside of the female mold element and fixed to the lower surface of the base plate 31. The female mold element 30*a* is pushed toward the convex portion 12 of the male mold 1 and retracted in the radial direction as shown by arrows in FIG. 5 so that the resilient element 33 is compressed to generate a spring-biasing force for the recovery.

Thus, when the pushing force is released or, in other words, when the concave forming surface 22*a* of the female mold 30 is released from the convex portion 12 of the male mold 1, the female mold elements 30*a* are returned to their original positions. In this case, the supporting members 37, 37 serve to restrict the female mold elements 30*a* from moving radially inwardly or toward a center, and cause the female mold elements 30*a* to stop at the same position.

In the embodiment of the present invention described above, a female mold 2 or 30 is positioned at an upper portion of the male mold 1, and the magnesium plate 5 is disposed between the convex portion 12 of the male mold 1 and the concave surface portion 22 of the female mold. On the upper surface of the magnesium plate 5, a plurality of (preferably two or three) thin resin films 6 such as a vinyl film or the like having a thickness of about 0.02 mm are superposed such that each of the superposed thin films 6 can be moved independently and separately from the adjacent films 6 and therefore, generation of a shrinkage or contraction between the die and the magnesium plate can be prevented so that a desired finish can be achieved.

The mounting table 3 for placing thereon the magnesium plate 5 is vertically movably disposed above the convex portion 12 of the male mold 1, and extension devices 7, 7 having hydraulic cylinders or the like are provided at both ends of the mounting table 3. In this state, the concave surface portion 22 of the female mold which is shown in FIG. 3 is placed on the mounting table 3 in a confronting relation with the convex portion 12, so that the base plate 21 of the female mold is pressed downwardly for starting a press working operation.

The convex portion 12 is projected through the opening 4 at a center of the mounting table 3 until it contacts a lower surface of the magnesium plate 5. A further projection or lowering of the female mold 2 presses a circumferential portion of the magnesium plate 5 by virtue of the female mold 2 having the aforementioned concave surface portion 22 to thereby achieve the predetermined deep draw forming.

The convex portion 12 should not initially cooperate with the concave surface portion 22 but rather a primary, pre-deep drawing should be conducted by the concave guide portion 23 which is disposed on the lower side of the concave surface portion 22 on the internal angle surface of the female mold element 21*a*. In this case, there is a small gap between the convex portion 12 and the concave guide portion 23. In the next step, the secondary or finishing fabrication should be conducted by the concave surface portion 22 which is disposed continuously at an upper portion of the concave guide portion 23, which gradually decreases in diameter.

In case of the step described above, if the concave surface portion 22 and the magnesium plate 5 contact directly with each other, it is likely that scratches and cracks are produced on a surface of the magnesium plate 5 and an excessive force is applied to the surface of the plate and therefore, it is quite difficult to provide a desired finish on the curved surface of the product. In the embodiment of the invention described above, however, provision of the resin thin films 6 serves to provide a desired sliding effect among the guide concave portion 23, the concave surface portion 22 and the magnesium plate 5. Thus, unnecessary and unreasonable force is not applied locally to the curved surface of the magnesium plate 5. Therefore, no shrinkage is produced on the surface of the magnesium plate 5 and generation of cracks or seams can be effectively prevented. Thus, a desired finish of a surface of the press-worked products can be obtained with no cracks or scratches.

An operation of the second female mold 30 will be described. When the female mold 30 shown in FIG. 5 is placed on the mounting table 3 above the male mold shown in FIG. 1; that is, when the male mold 1 is inserted into an opening C of the female mold which is positioned at a center of the four female mold elements 30*a,* a deep drawing is conducted at the circumferential portion of the magnesium plate to be formed, by virtue of the four female mold elements 30*a* which constitute the female mold 30.

The retraction of the female mold elements 30*a* in the direction shown by the arrows serves to lessen a concentrated burden or load at the corners of the deep drawn portion and enables a smooth fabrication of the deep drawn portion to be achieved. In this case, since two or three thin resin films 6 such as vinyl films are disposed between the magnesium plate 5 and the concave forming surface, a desirable sliding effect can be obtained between the magnesium plate 5 and the female mold 30.

A third embodiment of the invention will be described with reference to FIG. 6, in which a male mold or die 40 having a rectangular shape is fitted, facing in a downward direction, to a central portion of a lower surface of a rectangular plate 41 which is larger than the male mold 40. The plate 41 has at its four corners insertion holes 42 extending in a vertical direction, and supporting members 43 are vertically movably inserted into the insertion holes 42. A shrinkage restriction plate 44, which is larger than the male mold 40, is fixed at its four corners to lower ends of the supporting members 43, and springs 45 are mounted on the supporting members 43 between the shrinkage restriction plate 44 and the plate 41. The shrinkage restriction plate 44 has at its central portion an opening 46 for receiving therein the mold 40.

Figure 7:
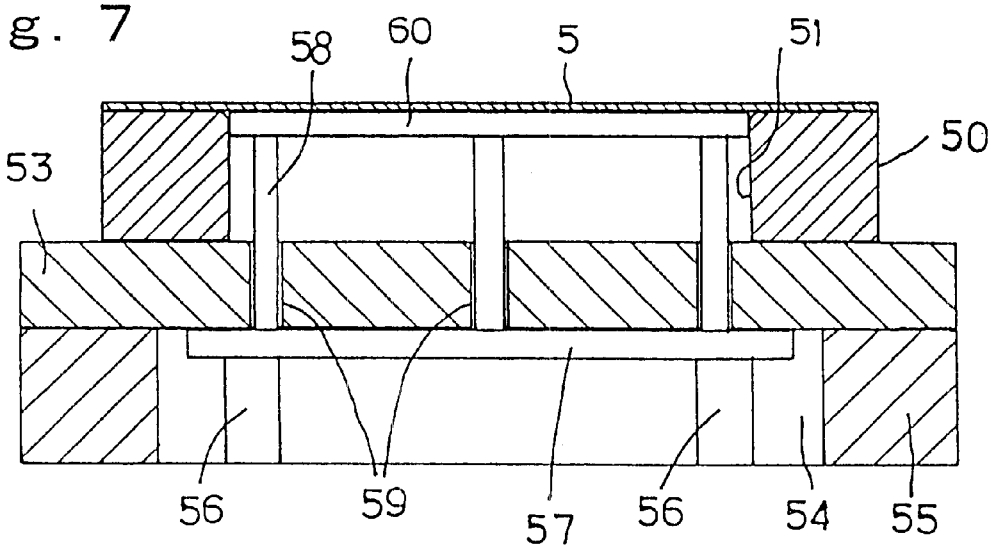
FIG. 7 is a sectional view of the female mold of the third embodiment on which a magnesium plate is placed.
Figure 8:
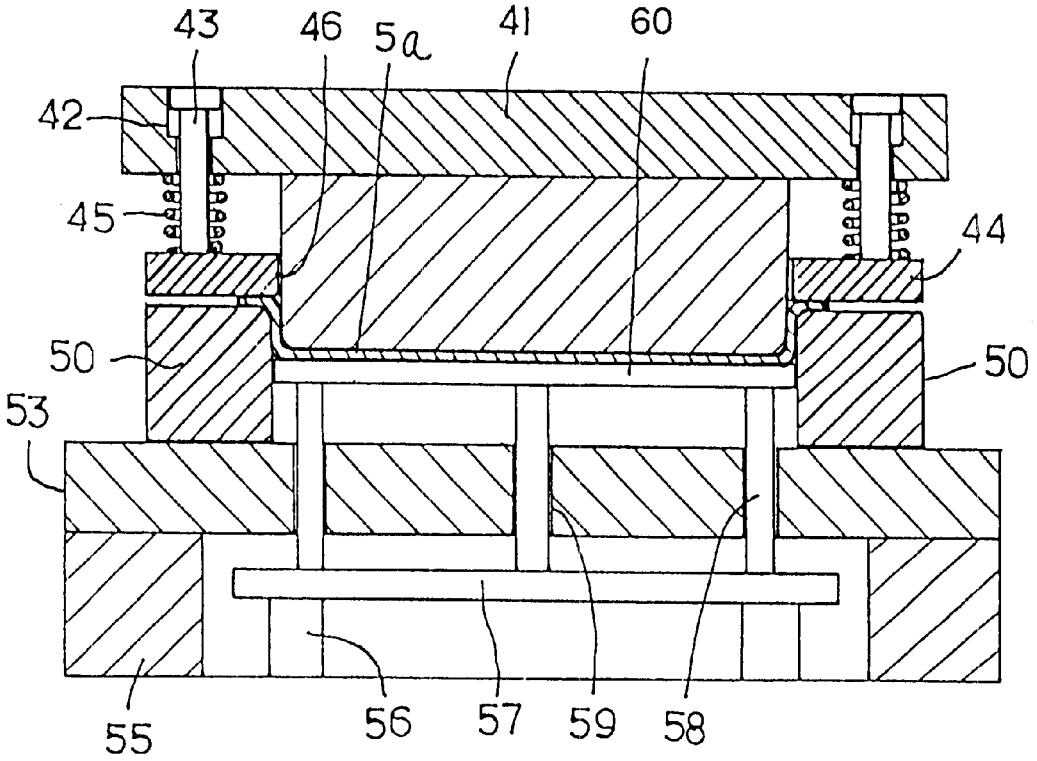
FIG. 8 is a sectional view of the male mold and the female mold for carrying out the deep drawing method of the third embodiment of the invention.
Figure 9:
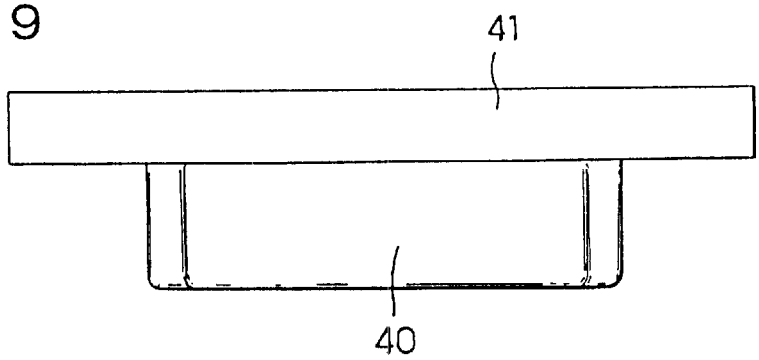
FIG. 9 is a front view of a second male mold according to the third embodiment of the invention.

With reference to FIG. 7 and FIG. 8, at the lower end of the each supporting member 43, a female mold or die 50, in a paired relation with the male mold 40, has a female mold portion 51 at its central portion and is placed on a upper central portion of a weighing plate 53. The weighing plate 53 is fitted on an upper portion of a base 55 (of substantially the same size) and provides a space 54 in the base 55. A plurality of resilient support members 56, 56 disposed in an upright posture within the space 54 are fitted at their upper ends to a supporting base 57, and a plurality of connecting rods 58, 58 are fitted to an upper surface of the supporting base 57 and extend through guide holes 59, 59 to be coupled with a lower surface of a cantilever plate 60, which is vertically movably positioned within the female mold portion 51. Ordinarily, the supporting base 57 is lifted upwardly by a resilient force of the resilient supporting members 56, and the cantilever plate 60 which is fitted to the upper end of the connecting rods 58 is set so that an upper surface of the cantilever plate 60 is positioned on the same plane as an upper surface of the female mold 50.

Figure 6:
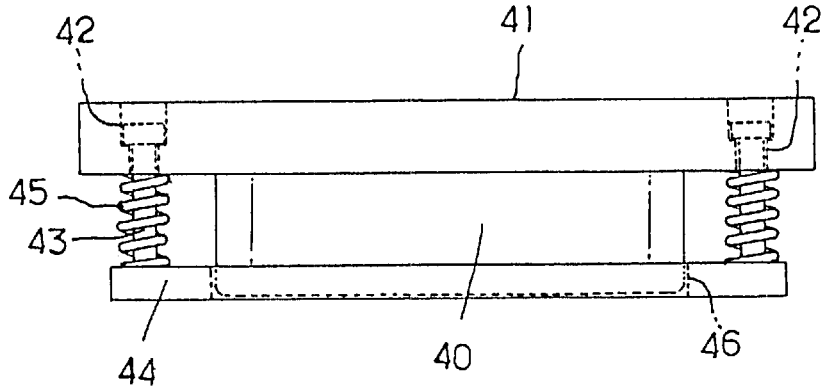
FIG. 6 is a front view of a male mold and a shrinkage restriction plate used for the deep drawing method according to a third embodiment of the invention.
Figure 10:
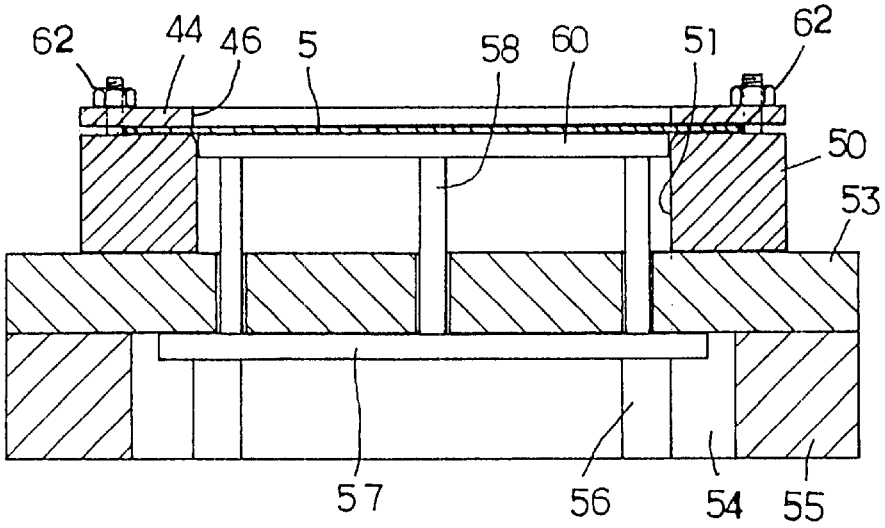
FIG. 10 is a sectional view of a second female mold according to the third embodiment of the invention.
Figure 11:
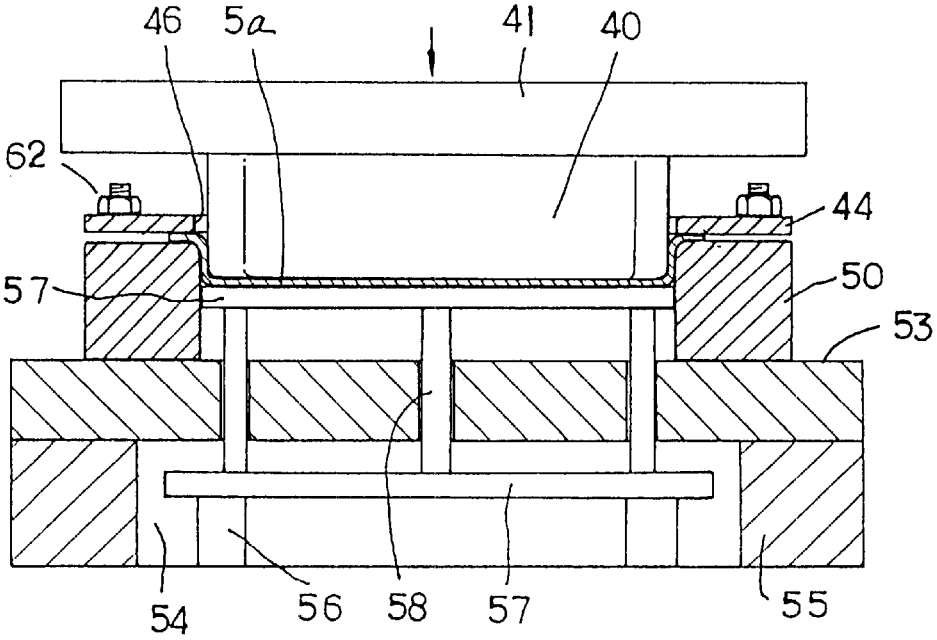
FIG. 11 is an explanatory diagram of the second male mold and the second female mold of the third embodiment, showing the condition of performing the deep drawing according to the invention.
Figure 14:
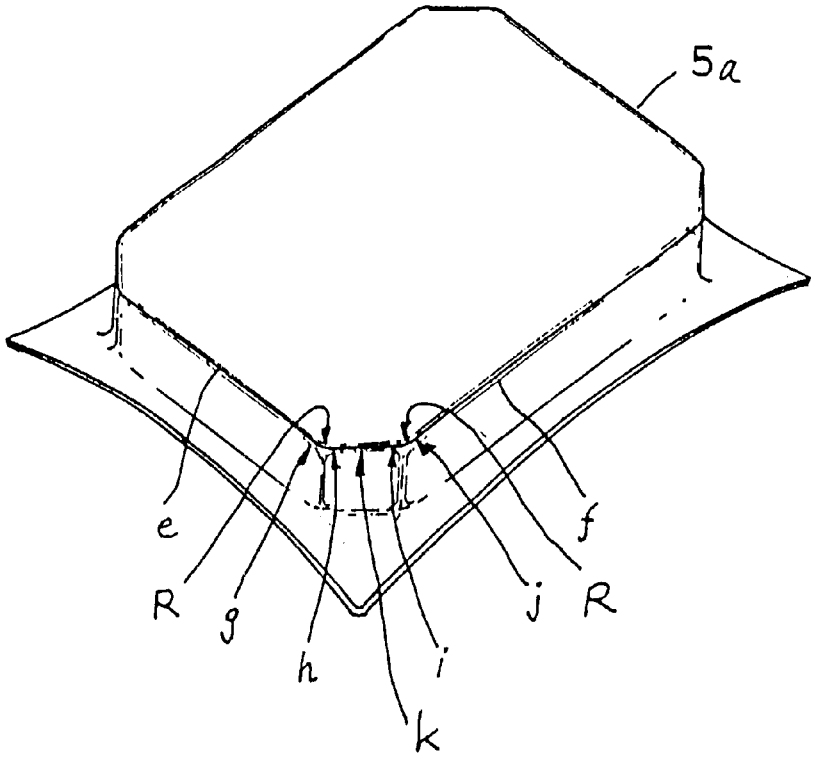
FIG. 14 is a perspective view of a product which is produced by press working by providing five points for concentration of force at a corner portion of a magnesium plate.

If desired, the shrinkage restriction plate 44 shown in FIG. 6 can be separated from the aforementioned plate 41 and be fitted to an upper surface of the female mold 50 by virtue of a fixture device 62 such as a bolt or the like as shown in FIG. 10. In operation, a circumferential portion of the magnesium plate 5 is caught and held by the shrinkage restriction plate 44 as shown in FIG. 8 and, as shown in FIG. 10, while the circumferential portion of the shrinkage restriction plate 44 is fitted to and held by the upper surface of the female mold 50 by the fixture device 62, the male mold 40 is inserted into the female mold portion 51 in the female mold 50 to thereby perform the press working, as shown in FIGS. 8 and 11.

In this case, the lower surface of the magnesium plate 5 is contacted by the cantilever plate 60, and therefore, as the male mold 40 is lifted upward after the press working is finished, a pressed product 5*a* is simultaneously lifted upward by a resilient force of the resilient supporting members 56 so that the product 5*a* will be discharged from the female mold 50. Although the thin resin films 6 are not illustrated in FIGS. 8 and 11, it should be anticipated that a desired number of thin resin films, such as two or three films, can be provided.

In the conventional method of deep draw forming by performing known press working, as illustrated in FIGS. 12 and 13, a force is concentrated on a relatively small number of places, such as three positions as two crossing points G and H along an arc B, which is inscribed in a region defined by a right-angled corner portion A and flat side surfaces E and F extending from the right-angled corner portion A, and a circumferential surface portion D that exists between the crossing points G and H. This has resulted in generation of cracks particularly when the material being defined is hard or rigid. Therefore, it has been proved that the press working has had substantial difficulty with regard to mass production due to a substantial reduction of yield. Thus, it is extremely difficult to place the arc B closer to the corner A.

Figure 15:
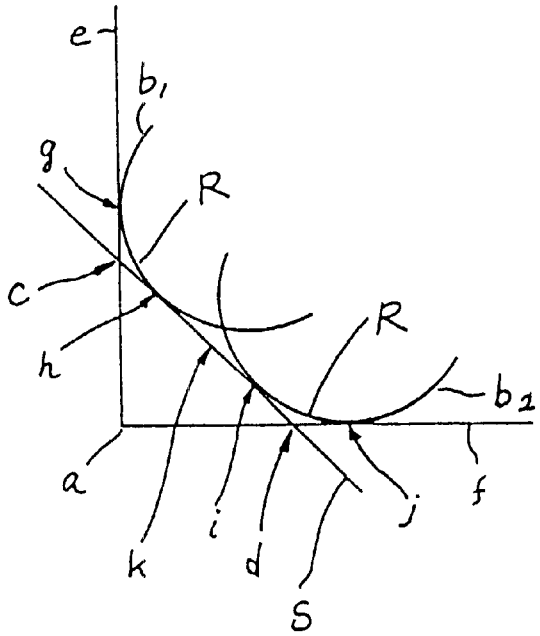
FIG. 15 is an explanatory diagram showing the five points at the corner of the product shown in FIG. 14.

In view of the foregoing difficulties in the conventional technique, a chamfering line s is provided by the present invention such that the chamfering line s is oblique relative to a right-angled corner a or mutually perpendicular side lines e and f which form the right-angled corner a, and cross points c and d exist where the chamfering line s and the side lines e and f intersect. Further, the internal angles between the chamfering line and the side lines are connected by two arcs b1 and b2 as illustrated in FIG. 15. Further, cross points or locations g and j, exist where the two side lines e and f are the tangent with the arcs b1 and b2. And, cross points or locations h and i exist where chamfering line s is tangent with the arcs b1 and b2, with a portion k of the chamfering lines existing between contact points h and i.

As described above, at corner portion a, five locations g, h, k, i and j, which is more than the three locations in the conventional technique, are formed for dispersing the forming force to the five locations. Thus, since there are five locations at which the force is dispersed, whereby the force applied to each of the locations is dispersed, a desired curved surface can be formed without generation of cracks and seams on the curved surface of a hard material such as the magnesium plate 5.

The curvature of the curved surface R of the arcs b1 and b2, which are inscribed within an internal angle formed by the combination of the side surface portions e and f, is determined so that the angles e-c-d and angle f-d-c form smooth curved surfaces. And, a radius of the arcs b1 and b2 is determined in accordance with products to be produced by the press working.

Figure 16:
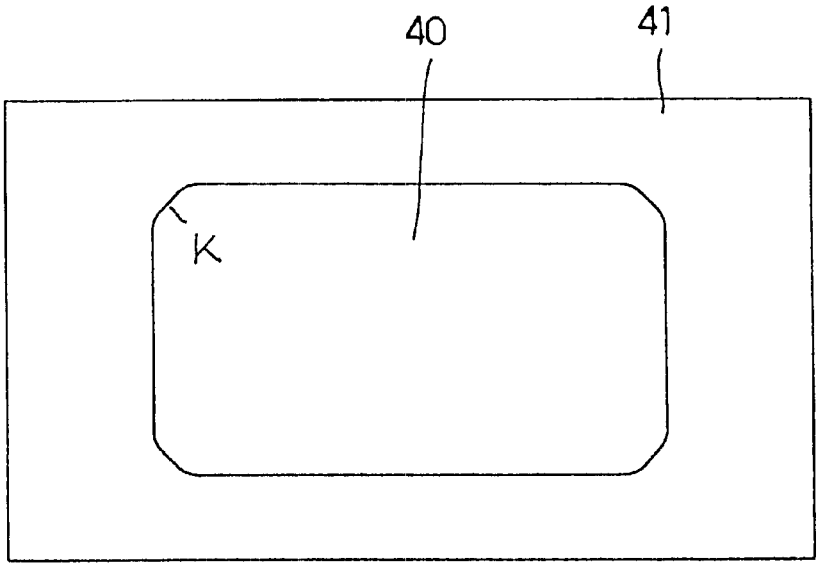
FIG. 16 is a bottom view of a male mold which has five cross points at its corner, seen from a lower portion thereof.
Figure 17:
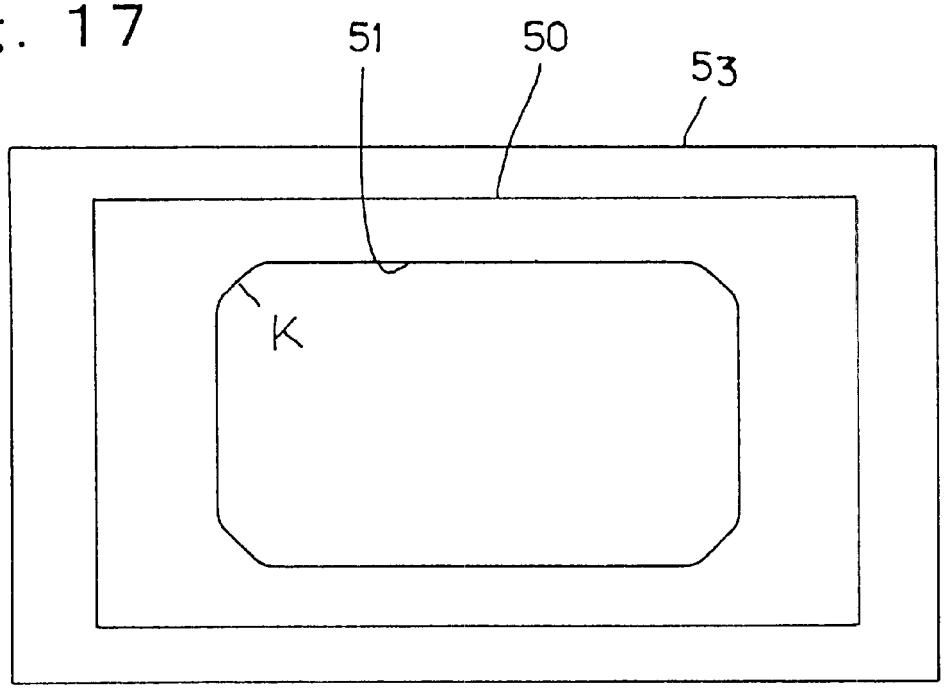
FIG. 17 is a plan view of a female mold resulting in five cross points at a corner of the product.

On the corner surfaces of the male mold 40 shown in FIG. 16 and on the corner portions of the female mold elements of the inner surface portions of the female mold 50, a flat surface portion which coincides with the aforementioned portion k, so that the number of contact locations are increased from three to five. Thus, concentration of force is dispersed to five locations to prevent the force from being concentrated locally, so that generation of cracks or seams on the curved surface portions can be prevented. The thus formed male mold is illustrated in FIG. 16 in which corner portions providing as many as five contact locations are provided for dispersing the force at these five locations and, similarly, the female mold for the same purposes is illustrated in FIG. 17.

Although the present invention has been described with reference to the examples which employ the magnesium plate as a molded material, it is to be understood that the present invention is also applicable to other hard metals which present some difficulty in forming. Further, the present invention can be applied to generally known soft metals into a desired shape.

The molding method according to the present invention provides advantages in that it can be applied not only to a general press working of hard metals such as magnesium, but also to deep draw forming of hard metals without using a large-scale instrument.

What is claimed is:

1. A method for deep drawing a plate, comprising:

contacting a plate with a male forming portion of a male die that is movable relative to a female die having a female forming portion;

placing plural superposed films on said plate; and with said plate in contact with said male forming portion, moving said female die relative to said male die such that said male forming portion and said female forming portion cooperate with one another to deform said plate, wherein said plural superposed films are freely movable relative to one another during the cooperation of said male forming portion and said female forming portion.

2. The method according to claim 1, wherein said male forming portion comprises a convex forming portion and said female forming portion comprises a concave forming portion, the moving of said female die relative to said male die includes moving said female die relative to said male die such that said convex forming portion is received within said concave forming portion, and the contacting of said plate with said male forming portion includes contacting said plate with said convex forming portion.

3. The method according to claim 2, wherein said plate comprises a magnesium plate and said plural superposed films comprise plural resin films.

4. The method according to claim 3, further comprising positioning said magnesium plate on a table that is between said male die and said female die and is movable in a direction axially towards and away from said male die.

5. The method according to claim 4, wherein said plural resin films comprise plural vinyl films each having a thickness of about 0.02 mm.

6. The method according to claim 4, wherein a base plate is attached to said female die, and the moving of said female die relative to said male die such that said female forming portion and said male forming portion cooperate with one another to deform said magnesium plate includes moving said base plate towards said male die such that said concave forming portion applies a force to said magnesium plate while said table is moved towards said male die with said convex forming portion remaining in contact with said magnesium plate.

7. The method according to claim 4, wherein said female die comprises four female elements extending from a surface of a base plate, with each of said four female elements exhibiting an L-shaped cross section and having:

(i) a concave forming surface at an end thereof that is proximate to said base plate, and (ii) an outwardly dilated guide surface extending from said concave forming surface to an end that is located distally from said base plate, wherein said four female elements define said concave forming portion, whereby moving said male die relative to said female die such that said male forming portion and said female forming portion cooperate with one another to deform said magnesium plate includes initially deforming said magnesium plate with said outwardly dilated guide surfaces of said four female elements and then further deforming said magnesium plate with said concave forming surfaces of said four female elements.

8. The method according to claim 4, wherein said female die comprises:

(i) four female elements extending from a surface of a base plate, with each of said four female elements exhibiting an L-shaped cross section and having a concave forming surface, and with each of said four female elements being radially movable relative to one another;

(ii) a resilient member mounted within each of said four female elements so that each of said four female elements can radially move relative to each other of said four female elements within a predetermined range; and (iii) supporting members fixed to said base plate to limit the extent to which said four female elements can move radially, with one of said supporting members being positioned between every two adjacent said four female elements, whereby moving said male die relative to said female die such that said male forming portion and said female forming portion cooperate with one another to deform said magnesium plate includes deforming said magnesium plate with said concave forming surfaces of said four female elements such that said four female elements are moved radially outwardly from a starting position in response to cooperation with said convex forming portion, and after completion of deformation of said magnesium plate, said resilient members bias said four female elements radially inwardly to the starting position.

9. The method according to claim 1, wherein said plural resin films each have a thickness of about 0.02 mm.

10. The method according to claim 1, wherein a base plate is attached to said female die, and the moving of said female die relative to said male die such that said female forming portion and said male forming portion cooperate with one another to deform said magnesium plate includes moving said base plate towards said male die such that said concave forming portion applies a force to said magnesium plate while said table is moved towards said male die with said convex forming portion remaining in contact with said magnesium plate.

11. The method according to claim 1, wherein said female die comprises four female elements extending from a surface of a base plate, with each of said four female elements exhibiting an L-shaped cross section and having:

(i) a concave forming surface at an end thereof that is proximate to said base plate, and (ii) an outwardly dilated guide surface extending from said concave forming surface to an end that is located distally from said base plate, wherein said four female elements define said concave forming portion, whereby moving said male die relative to said female die such that said male forming portion and said female forming portion cooperate with one another to deform said magnesium plate includes initially deforming said magnesium plate with said outwardly dilated guide surfaces of said four female elements and then further deforming said magnesium plate with said concave forming surfaces of said four female elements.

12. The method according to claim 1, wherein said female die comprises:

(i) four female elements extending from a surface of a base plate, with each of said four female elements exhibiting an L-shaped cross section and having a concave forming surface, and with each of said four female elements being radially movable relative to one another;

(ii) a resilient member mounted within each of said four female elements so that each of said four female elements can radially move relative to each other of said four female elements within a predetermined range; and (iii) supporting members fixed to said base plate to limit the extent to which said four female elements can move radially, with one of said supporting members being positioned between every two adjacent said four female elements, whereby moving said male die relative to said female die such that said male forming portion and said female forming portion cooperate with one another to deform said magnesium plate includes deforming said magnesium plate with said concave forming surfaces of said four female elements such that said four female elements are moved radially outwardly from a starting position in response to cooperation with said convex forming portion, and after completion of deformation of said magnesium plate, said resilient members bias said four female elements radially inwardly to the starting position.

13. A method for deep drawing a plate, comprising:

positioning a shrinkage restriction plate between a male die and a female die, with said shrinkage restriction plate having an opening for receiving said male die;

positioning a cantilever plate adjacent to a surface of said shrinkage restriction plate that faces away from said male die, with said cantilever plate being connected to one end of a coupling rod that has an opposite end fixed to a supporting base which is supported by a resilient support member, and with said cantilever plate being axially movable within said female die so that a surface of said cantilever plate can be co-planar with a surface of said female die that faces said male die; and axially moving said male die relative to said female die in a first direction such that said male die is received within said female die, whereby a plate having a circumferential portion held by said shrinkage restriction plate becomes deformed.

14. The method according to claim 13, wherein said plate comprises a magnesium plate.

15. The method according to claim 14, wherein the positioning of said shrinkage restriction plate includes mounting said shrinkage restriction plate to a base plate of said male die such that said shrinkage restriction plate is axially movable relative to said male die, and further comprising providing a resilient member for biasing said shrinkage restriction plate away from said base plate.

16. The method according to claim 14, wherein the positioning of said shrinkage restriction plate includes mounting said shrinkage restriction plate via a fixing member to the surface of said female die that faces said male die.

17. The method according to claim 14, wherein said male die includes a surface that is generally rectangular with four corner portions, and said female die includes an opening that corresponds in shape to that of said surface of said male die such that said opening also has four corner portions, with each of said four corner portions of said male die and each of said four corner portions of said female die having a first side and a second side interconnected by an end surface that extends obliquely to and intersects with said first side at a first location and extends obliquely to and intersects with said second side at a second location such that (i) a first arc that is within an angle defined by said first side and said end surface is tangent with said first side at a third location and is tangent with said end surface at a fourth location, and (ii) a second arc that is within an angle defined by said second side and said end surface is tangent with said second side at a fifth location and is tangent with said end surface at a sixth location, with said third location, said fourth location, said fifth location, said sixth location and a portion of said end surface located between said fourth location and said sixth location being interconnected by a continuous curve, and wherein axially moving said male die relative to said female die such that said male die is received within said female die includes axially moving said male die relative to said female die such that said four corner portions of said male die cooperate with said four corner portions of said female die, respectively, to deform said magnesium plate.

18. The method according to claim 17, wherein axially moving said male die relative to said female die such that said four corner portions of said female die cooperate with said four corner portions of said female die, respectively, to deform said magnesium plate includes dispersing a deforming force at each of said corner portions to said third location, said fourth location, said fifth location, said sixth location and said portion of said end surface located between between said fourth location and said sixth location, whereby generation of cracks on or shrinkage of deformed portions of said magnesium plate are effectively prevented.

19. The method according to claim 13, further comprising after deformation of said plate, axially moving said male die relative to said female die in a second direction such that said male die is removed from said female die, and said resilient support member, simultaneously with the relative axial movement of said male die in the second direction, causes said cantilever plate to move in the second direction to discharge the deformed plate from said female die.

20. The method according to claim 19, wherein the positioning of said shrinkage restriction plate includes mounting said shrinkage restriction plate to a base plate of said male die such that said shrinkage restriction plate is axially movable relative to said male die, and further comprising providing a resilient member for biasing said shrinkage restriction plate away from said base plate.

21. The method according to claim 19, wherein the positioning of said shrinkage restriction plate includes mounting said shrinkage restriction plate via a fixing member to the surface of said female die that faces said male die.

22. The method according to claim 19, wherein said male die includes a surface that is generally rectangular with four corner portions, and said female die includes an opening that corresponds in shape to that of said surface of said male die such that said opening also has four corner portions, with each of said four corner portions of said male die and each of said four corner portions of said female die having a first side and a second side interconnected by an end surface that extends obliquely to and intersects with said first side at a first location and extends obliquely to and intersects with said second side at a second location such that (i) a first arc that is within an angle defined by said first side and said end surface is tangent with said first side at a third location and is tangent with said end surface at a fourth location, and (ii) a second arc that is within an angle defined by said second side and said end surface is tangent with said second side at a fifth location and is tangent with said end surface at a sixth location, with said third location, said fourth location, said fifth location, said sixth location and a portion of said end surface located between said fourth location and said sixth location being interconnected by a continuous curve, and wherein axially moving said male die relative to said female die such that said male die is received within said female die includes axially moving said male die relative to said female die such that said four corner portions of said male die cooperate with said four corner portions of said female die, respectively, to deform said magnesium plate.

23. The method according to claim 22, wherein axially moving said male die relative to said female die such that said four corner portions of said female die cooperate with said four corner portions of said female die, respectively, to deform said magnesium plate includes dispersing a deforming force at each of said corner portions to said third location, said fourth location, said fifth location, said sixth location and said portion of said end surface located between between said fourth location and said sixth location, whereby generation of cracks on or shrinkage of deformed portions of said magnesium plate are effectively prevented.

24. The method according to claim 13, wherein the positioning of said shrinkage restriction plate includes mounting said shrinkage restriction plate to a base plate of said male die such that said shrinkage restriction plate is axially movable relative to said male die, and further comprising providing a resilient member for biasing said shrinkage restriction plate away from said base plate.

25. The method according to claim 13, wherein the positioning of said shrinkage restriction plate includes mounting said shrinkage restriction plate via a fixing member to the surface of said female die that faces said male die.

26. The method according to claim 13, wherein said male die includes a surface that is generally rectangular with four corner portions, and said female die includes an opening that corresponds in shape to that of said surface of said male die such that said opening also has four corner portions, with each of said four corner portions of said male die and each of said four corner portions of said female die having a first side and a second side interconnected by an end surface that extends obliquely to and intersects with said first side at a first location and extends obliquely to and intersects with said second side at a second location such that (i) a first arc that is within an angle defined by said first side and said end surface is tangent with said first side at a third location and is tangent with said end surface at a fourth location, and (ii) a second arc that is within an angle defined by said second side and said end surface is tangent with said second side at a fifth location and is tangent with said end surface at a sixth location, with said third location, said fourth location, said fifth location, said sixth location and a portion of said end surface located between said fourth location and said sixth location being interconnected by a continuous curve, and wherein axially moving said male die relative to said female die such that said male die is received within said female die includes axially moving said male die relative to said female die such that said four corner portions of said male die cooperate with said four corner portions of said female die, respectively, to deform said magnesium plate.

27. The method according to claim 26, wherein axially moving said male die relative to said female die such that said four corner portions of said female die cooperate with said four corner portions of said female die, respectively, to deform said magnesium plate includes dispersing a deforming force at each of said corner portions to said third location, said fourth location, said fifth location, said sixth location and said portion of said end surface located between said fourth location and said sixth location, whereby generation of cracks on or shrinkage of deformed portions of said magnesium plate are effectively prevented.

* * * * *